US007666564B2

(12) United States Patent
Asano et al.

(10) Patent No.: US 7,666,564 B2
(45) **Date of Patent: *Feb. 23, 2010**

(54) METHOD FOR FORMING IMAGE

(75) Inventors: Masao Asano, Tokyo (JP); Tomoe Kitani, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 239 days.

This patent is subject to a terminal disclaimer.

(21) Appl. No.: 10/969,641

(22) Filed: Oct. 19, 2004

(65) Prior Publication Data

US 2006/0083551 A1 Apr. 20, 2006

(51) Int. Cl.
*G03G 13/14* (2006.01)

(52) U.S. Cl. ..... 430/119.7; 430/123.5; 430/123.51; 430/125.3; 399/223

(58) Field of Classification Search ..... 399/223; 430/47, 119.7, 123.5, 123.51, 125.3
See application file for complete search history.

(56) References Cited

U.S. PATENT DOCUMENTS

| | | | | |
|---|---|---|---|---|
| 5,750,303 | A * | 5/1998 | Inaba et al. | 430/108.4 |
| 5,837,414 | A * | 11/1998 | Kitani et al. | 430/108.1 |
| 6,436,599 | B1 * | 8/2002 | Matsuoka et al. | 430/137.19 |
| 6,555,281 | B1 * | 4/2003 | Nozawa et al. | 430/108.6 |
| 6,582,867 | B2 * | 6/2003 | Serizawa et al. | 430/108.4 |
| 6,841,328 | B2 * | 1/2005 | Shirose et al. | 430/124 |
| 7,016,634 | B2 * | 3/2006 | Kitani et al. | 399/298 |
| 7,142,801 | B2 * | 11/2006 | Kitani et al. | 399/302 |
| 7,186,492 | B2 * | 3/2007 | Hayashi et al. | 430/108.4 |
| 2001/0019674 | A1 * | 9/2001 | Asano et al. | 399/223 |
| 2003/0027066 | A1 * | 2/2003 | Yamashita et al. | 430/105 |
| 2003/0198879 | A1 * | 10/2003 | Shirose et al. | 430/45 |
| 2004/0185361 | A1 * | 9/2004 | Yoshino et al. | 430/108.1 |
| 2004/0190951 | A1 * | 9/2004 | Kitani et al. | 399/299 |
| 2004/0248023 | A1 * | 12/2004 | Asano et al. | 430/45 |
| 2004/0265720 | A1 * | 12/2004 | Kadota | 430/108.6 |
| 2005/0003289 | A1 * | 1/2005 | Fushimi et al. | 430/108.3 |
| 2005/0026056 | A1 * | 2/2005 | Fujikawa et al. | 430/45 |
| 2005/0079429 | A1 * | 4/2005 | Hayami et al. | 430/45 |
| 2006/0029869 | A1 * | 2/2006 | Asano et al. | 430/45 |

FOREIGN PATENT DOCUMENTS

| | | |
|---|---|---|
| JP | 63-056658 | 3/1988 |
| JP | 63-271374 | 11/1988 |
| JP | 02-774534 | 6/1990 |

(Continued)

OTHER PUBLICATIONS

Abstract of JP 2004287166.*

(Continued)

*Primary Examiner*—Hoa V Le
(74) *Attorney, Agent, or Firm*—Squire, Sanders & Dempsey L.L.P.

(57) ABSTRACT

Disclosed is an image forming method employing an apparatus comprising a plurality of toner image forming units, which forms a plurality of toner images and transfer them onto an intermediate transferring member in sequence, and the transferred images is transferred onto a recording sheet. The developer is a non-magnetic single component toner and turbidity of toners of each color is less than 60; and the maximum turbidity difference among the toners is 5-45.

9 Claims, 4 Drawing Sheets

FOREIGN PATENT DOCUMENTS

| | | | |
|---|---|---|---|
| JP | 06-332324 | | 12/1994 |
| JP | 06-337598 | | 12/1994 |
| JP | 07-271142 | | 10/1995 |
| JP | 09319134 | * | 12/1997 |
| JP | 11-272003 | | 10/1999 |
| JP | 2001201881 | * | 7/2001 |
| JP | 2001-222129 | * | 8/2001 |
| JP | 2001228641 | * | 8/2001 |
| JP | 2001235879 | * | 8/2001 |
| JP | 2001235880 | * | 8/2001 |
| JP | 2001242756 | * | 9/2001 |
| JP | 2001-272810 | | 10/2001 |
| JP | 2002-351129 | | 12/2002 |

OTHER PUBLICATIONS

Abstract of JP 2004287167.*
English langauge translation of Japanese Patent No. 2001-222129 (Aug. 2001).*
Abstract of JP-2001222129 A. Aug. 17, 2001.*
Abstract of JP 09319134, Dec. 1997.*
Abstract of JP 2001201881, Jul. 2001.*
Abstract of JP 2001228641, Aug. 2001.*
Abstract of JP 2001235879, Aug. 2001.*
Abstract of JP 2001235880, Aug. 2001.*
Abstract of JP 2001242756, Sep. 2001.*
Japanese Office Action mailed Nov. 14, 2006, 7 pgs.

* cited by examiner

METHOD FOR FORMING IMAGE

FIELD OF THE INVENTION

The present invention relates to an image forming method and an image forming apparatus for the image forming method.

BACKGROUND OF THE INVENTION

A developing method employing a nonmagnetic single component developer has been known, in which a thin layered nonmagnetic single component developer is provided to a surface of a photorecepter to develop a latent image in an apparatus having a toner conveying member, toner layer regulating member and an auxiliary toner providing member (JP O.P.I. Publication No. 63-271374 and JP Patent No. 2774534). The toner is charged by frictional electrification of the non-magnetic toner with the toner conveying means or toner layer regulation member.

Generally development is conducted in a state that a developer conveying member is made into contact with a photoreceptor and a thin toner layer is formed on a surface of the developer conveying member in the non-magnetic single component development. Therefore, the toner layer must be thin and uniform, and quick and uniform electrification is required by frictional electrification with the developer conveying member etc., since there is no carrier which functions as a charge giving member employed in two component developer.

Therefore, improvements are proposed in view of various toners or development method employed in the non-magnetic single component development. For example, a toner having specified range of shape coefficient or variation coefficient of number particle size distribution is proposed for a non-magnetic single component development (JP O.P.I. No. 2001-272810). However, there has been such problems as generation of scattering of character image because of broad charge distribution, or generation of periodic image deficiency because of insufficient toner transfer.

It is recent tendency that color images are required even in the field of copying machine or printer. Color image forming methods with high practical value can be roughly classified according to usual called name into a transfer drum method, an intermediate transfer method, a method in which an image composed of a plurality of color toners is piled on a photoreceptor and transferred collectively, and a tandem method.

Such the names are each given from different viewpoint, accordingly, for example, a method composed of the intermediate transfer method and the tandem method can be naturally used. The color image forming apparatus by the tandem method is known as an apparatus giving a high quality full color image. In the tandem method, toner images are separately formed on photoreceptors each corresponding to color of yellow, magenta, cyan, or magenta, and the color images are piled on an intermediate transferring member and the piled image is collectively transferred onto an image recording material.

In the tandem image forming method, an image defect caused by imperfect transfer of the toner image tends to occur since the method includes two transfer steps, the first transfer step for transferring the toner image from each of the photoreceptors to the intermediate transferring member and the second step for transferring the image from the intermediate transferring member to the recording paper.

An image forming method employing the tandem color image forming apparatus having an intermediate transferring member in combination with a non-magnetic single component developer having certain toner turbidity is proposed (JP O.P.I. Publication No. 2001-222129). The investigation is not adequate to form an image by the non-magnetic single component developer as well as the first and second transfer process and sufficient color image has not been obtained by this method.

For example, the imperfection of the transfer of the toner from the photoreceptor to the intermediate transferring member tends to cause image defects such as reducing of image density and lacking of transferred image. Besides, it has been reported that the imperfection of the toner transfer from the intermediate transferring member to the image recording paper causes scattering of character image and lowering of sharpness caused by rebound of the toner in the transfer process and periodical defects caused by toner filming on the photoreceptor.

For improving the charging property, developing ability and transferring ability, which are cause of the toner transfer lacking and the character image scattering, and for preventing toner filming or improving the imperfection of cleaning, techniques have been investigated by which fine particles are added into the photoreceptor layer to give irregularity to the surface thereof so that the toner adhesive force of the photoreceptor surface is reduced for improving the transfer ability and for reducing the frictional force of the surface to a blade. For example, JP O.P.I. Publication No. 5-181291 discloses that fine particles of alkylsilsesquioxane resin are added in the photosensitive layer. A problem rises, however, that the transfer ability tends to be lowered under a high humidity condition since the fine particles of alkylsilsesquioxane resin has hygroscopicity and the wettability of the photoreceptor surface or the surface energy of the surface is raised under such the condition. On the other hand, an electrophotographic photoreceptor containing particles of fluororesin for reducing the surface energy has been disclosed. However, sufficient surface strength cannot be obtained by the fluororesin particles and line-shaped defects caused by damage of the photoreceptor surface and image scattering tend to occur, (JP O.P.I. Publication No. 63-56658).

Besides, a technique for improving the transferring ability of the intermediate transferring member by supplying a solid lubricant to the intermediate transferring member to lower the surface energy is disclosed in, for example, JP O.P.I. Publication Nos. 6-337598, 6-332324 and 7-271142. It is found, however, that the solely controlling of the surface property of the intermediate transferring member is insufficient for improving the total transferring ability in the image forming method having the twice transfer processes using the intermediate transferring member, and further improvement is necessary regarding the copy image formation for a long period or under a high temperature and humidity condition.

From the viewpoint of the electrophotographic process, the image formation process is roughly classified into an analogical image formation using a halogen lamp as the light source and a digital image formation using a LED or laser as the light source. Recently, the main stream of the technology is rapidly changed, in the field of not only the printer for personal computer but the ordinary copy machine, to digital image forming method since the processing of image and the expansion to a complex image forming machine are easy realized.

Higher quality of the image tends to be required to the digital image forming method since such the method is applied for not only copying but formation of an original image.

U.S. Pat. No. 5,837,414 discloses toner comprising fine particles having a releasing index of 10 to 50 in terms of a turbidity.

It is found that improvement is necessary on the toner transferring ability of both of the primary transfer and the secondary transfer in total by controlling the balance between the surface energy of the electrophotographic photoreceptor and that of the intermediate transferring member and improving the properties of the toner to suit to the intermediate transfer method.

The object of the invention is to provide a good electrophotographic color image by the image forming apparatus using the intermediate transferring member, particularly to provide an electrophotographic image forming apparatus and an image forming method by which the lacking of toner transfer the scattering of character image and the degradation of sharpness are improved, which are easy to occur in the color image formed by the apparatus using the intermediate transferring member, so as to form a color image with high sharpness and clear hue when the fine dot image or a lot of the images are formed.

SUMMARY

An image forming method employing an apparatus comprising a plurality of image forming units, an intermediate transferring member, an end transferring device and a fixing device, in which the plurality of image forming units each comprises, an electrophotographic photoreceptor, a latent image forming device to form an electrostatic latent image on the electrophotographic photoreceptor, a developing device to develop the electrostatic latent image with a developer comprising a toner to form a toner image on the electrophotographic photoreceptor, a first transferring device to transfer the toner image onto the intermediate transferring member, and a cleaning device to remove a toner remaining on the electrophotographic photoreceptor after transferring the toner image, wherein the method comprises forming a plurality of toner images on the photoreceptors, each of toner image having a different color;

transferring each of the toner images onto the intermediate transferring member from the photoreceptor by the first transferring device in each of the image forming units in sequence;

transferring the toner images formed on the intermediate transferring member simultaneously onto a recording sheet by the end transferring device; and wherein the developer is a non-magnetic single component toner and turbidity of toners of each color is less than 60; and the maximum turbidity difference among the toners is 5-45.

DETAILED DESCRIPTION OF PREFERRED EMBODIMENT

Figure 2:
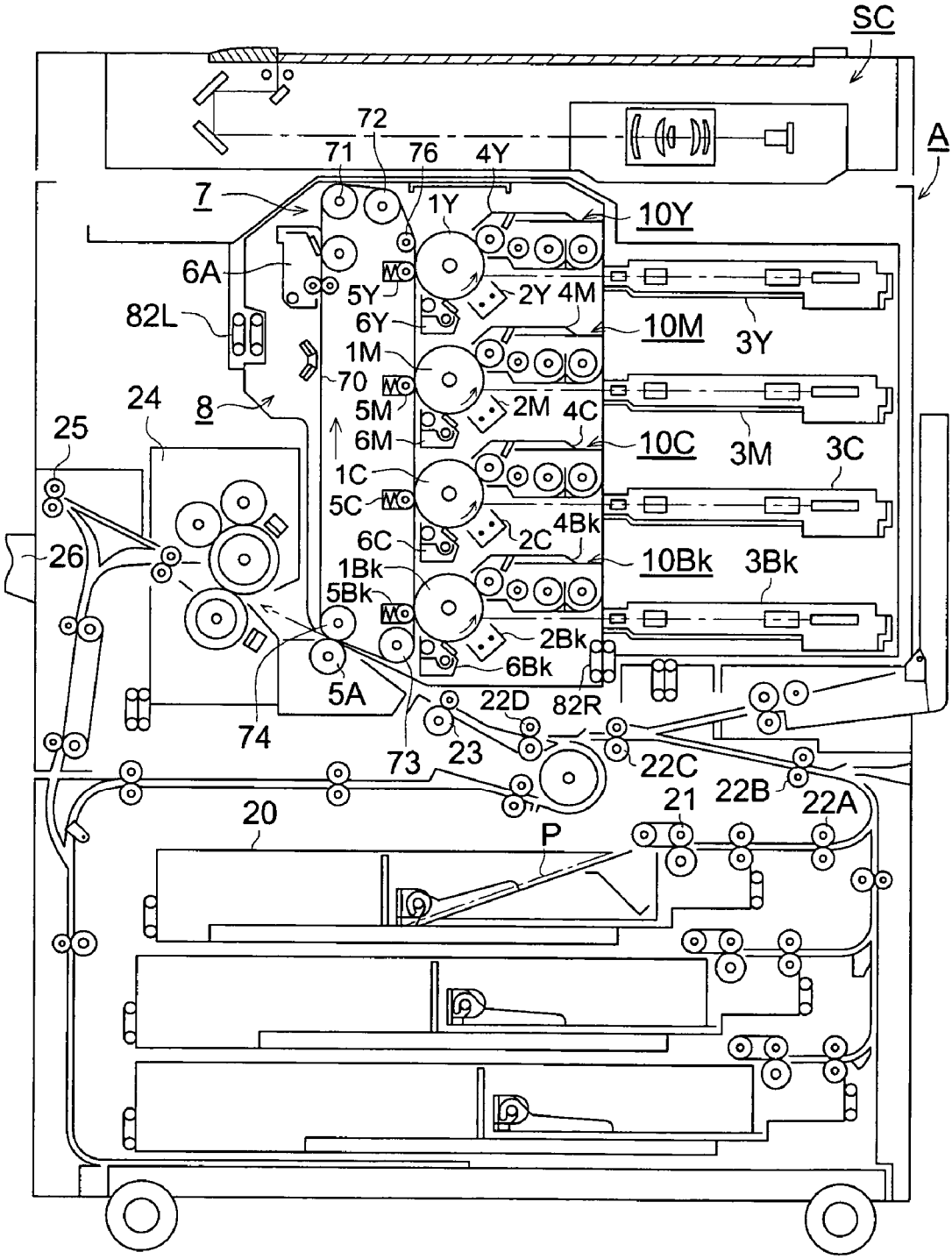
FIG. 2 shows a cross section of an example of a color image forming apparatus.

FIG. 2 is a schematic view of an example of an apparatus which can be applied to the image forming method. Toner image having different color are formed on photoreceptors 1Y, 1M, 1C and 1Bk in each image forming units 19Y, 19M, 19C and 19Bk, and the images are transferred to an intermediate transferring member 70 in sequence to form a color image. The color image formed on the intermediate transferring member is transferred to a recording sheet P and fixed.

The photoreceptor in at least one of the image forming unit preferably comprises a fluororesin in the surface layer.

At least one of the image forming units preferably comprises a member providing a surface energy reducing agent to the photoreceptor.

Difference of maximum turbidity and minimum turbidity of toners used in each image forming unit is preferably 10 to 35.

The image forming apparatus preferably contains a black image forming unit, a yellow image forming unit, magenta image forming unit, and a cyan image forming unit.

The black toner has a turbidity of not more than 20.

The non-magnetic single component developer is composed of fundamentally non-magnetic toner without carrier component.

The turbidity of the toner can be defined and measured as follows.

Turbidity; HAZE value=Scattered light amount/Total transmitted light amount×100 (%)

Measurement of Turbidity:

Into 50 ml of an aqueous solution containing 1 ml of a surfactant to make 0.7% aqueous solution of dodecylbenzene sulfonic acid, 5.0 g of toner is dispersed for 5 minutes by a magnetic stirrer and then separated by a centrifuge for 10 minutes at 300 G±15 G. The toner is precipitated and the supernatant liquid containing the free ingredient is sampled. The sampled liquid is subjected to measurement by a turbidity meter (COH-300A, manufactured by Nippon Denshoku Industries Co., Ltd.) with 500 nm filter, and the ratio of the scattered light amount to the total transmitted light amount is calculated to determine the HAZE value as the turbidity of the toner.

While the centrifugal force is allowable range of 300 G±15 G since the centrifugal force may not be precisely determined due to machines, it should be preferably set as close as 300 G.

The supernatant liquid should be taken so carefully that the separated component is not dispersed in the supernatant liquid again.

When the measured turbidity has values fallen within and outside of the present invention because the centrifugal force is allowed within the range of 300 G±15 G, the turbidity is the average value obtained by maximum and minimum centrifugal force within 300 G±15 G, so as to determine the turbidity is fallen within or outside of the invention.

Example of the surfactant is "Senjoryoku Family" produced by Kao Co., Ltd.

A lager turbidity value of the toner means a larger amount of the free fine particle ingredient such as the external additive.

In the invention, the transferring ability of the color toner images piled up onto the intermediate transferring member is considerably improved and the image defects such as the lacking of toner transfer, scattering of character image, and the cyclical image defect caused by toner filming on the intermediate transferring member are also considerably improved, and a color image having high sharpness and clear hue can be formed by the use of a group of toners each having a turbidity of less than 60 and the largest difference among the toners is from 5 to 45.

The toner having the turbidity value of less than 60, scattering of free ingredient is restrained on the photoreceptor and the intermediate transferring member and therefore the character scattering or the lowering of sharpness is minimized. Furthermore, excess amount of free ingredient does not adhere onto the photoreceptor surface so that the image defects such as a black spot (strawberry like-shaped spot image) are minimized. In case that the difference of turbidity among the toners having a different color is between 5 and 45, the transferring ability of the toner from the photoreceptor to the recording material or the intermediate transferring member and that of the toner from the intermediate transferring member to the recording material are kept satisfactorily, and sufficient image density of the color image and sharpness is obtained. The turbidity of the each color toner is less than 60, preferably less than 50, and most preferably less than 40. The turbidity of the each color toner preferably exceeds 5. Besides, the largest difference of the turbidity among the color toners is from 5 to 45, and more preferably from 10 to 35.

A group of toners composed of a black colored toner, a yellow colored toner, a magenta colored toner and a cyan colored toner is preferably used as the color toners. The character image and the color image with high sharpness and clearness can be formed by the use of such the four-color toners.

Among the color toners, the turbidity of the black toner is preferably less than 20. When the turbidity of the black toner is less than 20, the sharpness and the color reproducibility of both of the character image and the color image are difficultly degraded and good images can be stably formed.

Among the color toners forming a color image, the toner having the largest turbidity is preferably the yellow colored toner. The yellow toner difficultly causes lowering of the sharpness and the hue even when the turbidity is made larger.

For controlling the turbidity of the toner according to the foregoing definition and the measuring method so as to be less than 60, and for controlling the largest difference of the turbidity among the toners so as to be from 5 to 45, it is necessary to suitable selection of the kind of the external additive to be adhered onto the toner surface and to control the adhering strength of the external additive particle, hereinafter simply referred to as the external additive, to the toner surface.

The number average particle diameter of the external additive preferably to be used in the invention is from 0.05 to 0.5 μm.

Under such a diameter condition of the external additive, sufficient transferring ability is obtained since the physical adhesive force between the toner and the photoreceptor is reduced by the external additive.

Further, the external additives are kept to adhere to the toner particle even by the stress caused by stirring in the developing means and does not generate free external additive particles, which sometimes are re-aggregated in the developing vessel and causes the lacking of toner transfer. Since an amount of the free external additives is restrained filming is also restrained on the photoreceptor face.

The adding amount of the external additives is preferably from 0.05 to 5.0 parts by weight, and particularly preferable from 1.0 to 4.0 parts by weight, per 100 parts of the colored particles before the addition of the external additive. Hereinafter, the "part" means the "part by weight" unless a specific comment is attached.

When the adding amount is less than 0.05 parts, the transferring ability tends to be lowered since the effect of the lowering of the physical adhering force. When the adding amount exceeds 0.5 parts, the external additive particles tend to be easily released from the toner surface by the stress of stirring in the developing vessel since excessive external additive particles are at the toner surface. The released particles are accumulated in the developing vessel and re-aggregated. When the re-aggregated particle is mixed within the developed toner image, the aggregate acts as the nucleus and tends to cause the lacking of toner transfer. Moreover, the filming tends to occur since many freed component particles are adhered onto the photoreceptor face.

The method for controlling the adhering situation of the external additive to the colored particle is not limited and any externally adding device usually used for fine particles and various apparatus for fixing or adhering the fine particle onto the toner surface can be used.

Henschel mixer, Loedige Mixer and Turbo Sphere mixer can be used as the concrete apparatus for fixing the particles onto the toner surface. Among them, Henschel mixer is suitably used from the viewpoint of easiness of mixing, stirring and external heating. Moreover, the mixing and fixing of the external additive can be performed by the same apparatus in the case of Henschel mixer.

The foregoing fixing treatment is preferably performed with a circumstance speed of the end of the stirring wing of from 5 to 50 m/s, and more preferably from 10 to 40 m/s. It is preferable that the external additive particles are uniformly adhered onto the toner particle surface by preliminary mixing. The temperature is preferably controlled at suitable temperature by externally heating by using warm water.

The temperature is measured at the flowing portion of the toner in the course of the stirring and mixing of the toner.

It is preferably that the toner is cooled by passing cold water and crushed, after the fixing treatment.

For controlling the adhesive degree if the external additive to the colored particle surface, the colored particles and the external additive particles are mixed by stirring at a temperature of from Tg−20° C. to Tg+20° C. while application mechanical impact and the time for mixing is optionally controlled. Thus the external additive particles can be uniformly adhered to the colored particle surface.

The Tg is the glass transition point of the toner or the binder resin constituting the toner. The glass transition point is measured by a differential scanning calorimeter DSC7, manufactured by Parkin-Elmer Co., Ltd. The sample is heated from 0° C. to 200° C. in a rate of 10° C./min. and cooled from 200° C. to 0° C. in a rate of 10° C./min. for erasing the history, and then heated from 0° C. to 200° C. in a rate of 10° C./min. to determine the temperature of endothermic peak of the second heating. The temperature of the peak is determined as the Tg. When plural peaks are observed, the temperature of the principal peak is defined as the Tg.

The Tg of the toner or the binder resin constituting the toner is preferably from 40° C. to 70° C., in view of storage ability of the toner, fixing ability and the productivity of the toner.

Additional external additive may be added after controlling the adhesion of the external additive from the viewpoint of the fluidity of the toner. In such the case, it is also necessary that the toner satisfy the turbidity condition mentioned above.

The number average particle diameter of the external additive is observed by a transmission electron microscope and measured by an image analyzing apparatus.

An optional external additive may be used.

For example, various kinds of inorganic oxide, nitride and boride are suitably usable. Example of the inorganic compound include silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, titanium carbide, silicon nitride, titanium nitride and boron nitride.

The foregoing inorganic external additive may be subjected to a hydrophobilizing treatment. When the hydrophobilizing treatment is applied, it is preferable that the treatment is performed by the use of a coupling agent such as various kinds of titanium coupling agent and silane coupling agent. Ones hydrophobilized by a metal salt of higher fatty acid such as aluminum stearate, zinc stearate and calcium stearate are also preferable.

When a resin external additive is used, the composition of the additive is not limited. Generally, as the external additive, a vinyl type organic external additive particle, a particle of a melamine-formaldehyde condensation product, polyester resin, a polycarbonate resin, a polyamide resin and a polyurethane resin are preferred since such the particles can be easily produced by an emulsion polymerization method or a suspension polymerization method.

The toner preferably to be used in the invention is described bellow.

The particle size of the toner according to the invention is preferably from 3 to 8 μm in the number average particle diameter. When the toner particles are prepared by a polymerization method, the particle diameter can be controlled according to the concentration the aggregating agent, the adding amount of the organic solvent, the time for aggregation and the composition of the resin it self in the later-mentioned production method of the toner.

When the number average diameter of the toner particles is from 3 to 8 μm, the fine toner particles, which have high adhesion force and causes filming by adhesion to the photoreceptor, are decreased so that the transferring efficiency of the toner is raised. As a result of that, the quality of halftone is improved and the quality of a fine line and dot is raised.

The toner preferably has a sum M of at least 70 percent. Said sum M is obtained by adding relative frequency m1 of toner particles, included in the most frequent class, to relative frequency m2 of toner particles included in the second frequent class in a histogram showing the particle diameter distribution, which is drawn in such a manner that natural logarithm lnD is used as an abscissa, wherein D (in μm) represents the particle diameter of a toner particle, while being divided into a plurality of classes at intervals of 0.23, and the number of particles is used as an ordinate.

By maintaining the sum M of the relative frequency m1 and the relative frequency m2 at no less than 70 percent, the variance of the particle diameter distribution of toner particles narrows. As a result, by employing said toner in an image forming process, the minimization of generation of selective development may be secured.

In the present invention, the above-mentioned histogram showing the particle diameter distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1,84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle diameter distribution analyzing program.

(Measurement Conditions)

(1) Aperture: 100 μm (2) Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

The number average particle diameter, the volume average particle diameter (D4) and particle diameter distribution of toner particles can be obtained by employing a Coulter Counter TA-II, a Coulter Multisizer, SLAD 1100 (a laser diffraction type particle diameter measuring apparatus, produced by Shimadzu Seisakusho), and the like.

A polymerization toner is preferable since the production method of the polymer is simple and the toner is superior to a crashed toner in the uniformity.

The polymerized toner is a toner produced by a process for polymerizing a monomer to prepare the toner binder resin, a process for making the shape of the toner particle, and a process for a chemical treatment to be applied thereafter. In concrete, the toner is prepared by polymerization reaction such as suspension polymerization and emulsion polymerization and an aggregation process for aggregating the particles with each other carried out after the polymerization. By the polymerization method the toner having uniform particle size and shape can be obtained since the monomer is uniformly dispersed in an aqueous medium and then polymerized in such the method.

The objects of the invention can be attained any toner either one prepared by the crushing method or the polymerization method as long as the toner satisfies the requirements of the invention.

The toner to be used in the invention may be produced by a usually applied pulverization method by which a binder resin, a colorant, and additives to be added according to necessity are kneaded, crushed and classified, or a method in which the toner resin particle containing a mold releasing agent and a colorant is synthesized in a medium.

Listed as methods for fusing fine resin particles in a water-based medium may be those described in, for example, Japanese Patent Publication Open to Public Inspection Nos. 63-186253, 63-282749, 7-146583, and others. Listed as the most preferable fusing method is one in which fine resin particles are subjected to salting-out/fusing in a water-based medium.

The weight average particle diameter of fine resin particles, which are employed to obtain the toner of the present invention, is preferably between 50 and 2,000 nm. Such fine resin particles may be obtained employing any of the several granulation polymerization methods such as an emulsion polymerization method, a suspension polymerization method, a seed polymerization method, and the like. The preferred are fine resin particles which are obtained employing the emulsion polymerization method.

A monomer to be used for production of the resin is described below. A known polymerizable monomer can be used in both of the methods by the kneading, crushing and classifying and by the synthesizing the toner resin particle in the medium. One or more kinds of the monomer may be used in combination to satisfy required properties.

A binder resin such as a styrene resin, an acryl resin, a styrene-acryl resin, a polyester resin, a styrene-butadiene resin, and an epoxy resin may be used.

The monomers for constituting the styrene resin, the acryl resin and the styrene-acryl resin include the followings: a styrene and a styrene derivative such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecyl styrene; a methacrylic ester derivative such as methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate; and an acrylic ester derivative such as methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate, phenyl acrylate, dimethylaminoethyl acrylate, and diethylaminoethyl acrylate. These monomers may be used solely or in combination.

Monomers usable in another vinyl polymer include the followings: an olefin such as ethylene, propylene, and isobutylene; a halogenized vinyl compound such as vinyl chloride, vinylidene chloride, vinyl bromide, vinyl fluoride, and vinylidene fluoride; a vinyl ester such as vinyl propionate, vinyl acetate, and vinyl benzoate; a vinyl ether such as vinyl methyl ether, and vinyl ethyl ether; a vinyl ketone such as vinyl methyl ketone, vinyl ethyl ketone, and vinylhexyl ketone; an N-vinyl compound such as N-vinylcarbazole, N-vinylindole, and N-vinylpyrrolidone; a vinyl compound such as vinylnaphthalene, and vinylpyridine; and a derivative of acrylic acid and methacrylic acid such as acrylonitrile, methacrylonitrile, N-butylacrylamide, N,N-dibutylacrylamide, methacrylamide, N-butylmethacrylamide, and N-octadecylacrylamide. These vinyl monomers may be used solely or in combination.

Examples of monomer to obtain a carbonic acid polymer of styrene-acryl resin (vinyl resin) include acrylic acid methacrylic acid, α-ethylacrylic acid, fumaric acid, maleic acid, itaconic acid, cinnamic acid, monobutyl maleate, monooctyl maleate, cinnamic anhydride, and a methyl half ester of alkenylsuccinic acid.

A crosslinking agent such as vinylbenzene, ethylene glycol diacrylate, diethylene glycol diacrylate, triethylene glycol diacrylate, ethylene glycol dimethacrylate, diethylene glycol dimethacrylate, and triethylene glycol dimethacrylate.

The polyester resin is a resin produced by the condensation polymerization of a di- or more-valent carbonic acid component and a di- or more-valent alcohol component. Examples of the di-valent carboxylic acid include maleic acid, fumaric acid, citraconic acid, itaconic acid, glutaconic acid, phthalic acid, isophthalic acid, terephthalic acid, succinic acid, adipic acid, sebacic acid, azelaic acid, malic acid, n-dodecylsuccinic acid, n-dodecenylsuccinic acid, isododecylsuccinic acid, n-octylsuccinic acid, and n-octenylsuccinic acid. Anhydride compounds of those are also usable.

Examples of di-valent alcohol constituting the polyester resin include an etherized bisphenol such as polyoxypropylene (2,2)-2,2-bis(4-hydroxyphenyl)propane, polyoxypropylene(3,3)-2,2-bis(4-hydroxyphenyl)propane, polyoxypropylene(2,0)-2,2-bis(4-hydroxyphenyl)propane, polyoxypropylene(2,0)-polyoxyethylene(2,0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanedimethanol, dipropylene glycol, polyethylene glycol, polypropylene glycol, polytetramethylene glycol, bisphenol A, bisphenol Z, and hydrogenated bisphenol A.

Examples of monomer of a polyester resin having a crosslinked structure include the following tri-valent carboxylic acid such as 1,2,4-benzenetricarboxylic acid, 2,5,7-naphthalene tricarboxylic acid, 1,2,4-naphthalene tricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and an empole trimer acid. The crosslinked polyester resin may also be produced by addition of an anhydride compound of these acids, or a polyvalent alcohol such as sorbitol, 1,2,3,6-hexanetetrol, 1,4-sorbitan, pentaerythritol, dipentaerythritol, tripentaerythritol, 1,2,4-pentanetriol, 1,2,5-pentanetriol, glycerol, 2-methylpropane triol, 2-methyl-1,2,4-butanetriol, trimethylolethane, trimethylolpropane, and 1,3,5-trihydroxymethylbenzene.

Inorganic or organic pigments are employed in a black (Bk) toner, a yellow (Y) toner, a magenta (M) toner and a cyan (C) toner for coloring agent.

Practical inorganic pigment is listed below.

Carbon black such as furnace black, channel black, acetylene black, thermal black and lamp black is exemplified as black pigment. Magnetic powders such as magnetite and ferrite are employed for black pigment.

These inorganic pigments can be used individually or two or more in combination optionally selected according to needs. And the content of pigment is usually 2-20 weight %, and preferably, 3-15 weight % of polymer.

An organic pigment can be also employed. Practical organic pigment is exemplified below.

Magenta or Red Pigment

C.I. Pigment Red 2, C.I. Pigment Red 3, C.I. Pigment Red 5, C.I. Pigment Red 6, C.I. Pigment Red 7, C.I. Pigment red 15, C.I. Pigment red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Orange or Yellow Pigment

C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I and Pigment Yellow 138.

Green or Cyan Pigment

C.I. Pigment Blue 15, C.I. Pigment Blue 15:2, C.I. Pigment Blue 15:3, C.I. Pigment Blue 16, C.I. Pigment Blue 60 and C.I. Pigment Green 7.

These organic pigments can be used individually or two or more jointly selected according to needs. And content of pigment is 2-20 weight % and preferably 3-15 weight % for polymer.

The colorant subjected to surface modification can be employed. The practical surface modifying agent includes silane coupling agent, titanium coupling agent and aluminum coupling agent.

So-called external additive is added to toner of the present invention for a purpose of improvement of fluidity, charging characteristics and cleaning characteristics. Various kinds of inorganic fine particles, organic fine particles and lubricant can be employed.

As lubricant, for example, stearic acid salt of such as zinc, aluminum, copper, magnesium and calcium, salt of oleic acid of such as zinc, manganese, iron, copper and magnesium, palmitic acid salt of such as zinc, copper, magnesium and calcium, linoleic acid salt of such as zinc and calcium, ricinoleic acid salt of such as zinc and calcium, and metal salt of higher fatty acid are given.

Content of this external additive is preferably around 0.1 to 5 weight % for toner.

In the toner preparation process the above mentioned additives may beaded to the toner particles obtained by above process, for the purpose of, for example, improving fluidity, charging characteristics and cleaning characteristics.

In order to add said additives various mixers such as a tubular mixer, a Henschel mixer, a Nauter mixer, a V-shaped mixer, and the like may be employed.

The toner may contain, in addition to binder resin and colorant, materials giving various function. Practically, releasing agent and charge controlling agent are exemplified.

Specifically, examples of-the releasing agent includes conventional one, practically, olefin waxes such as polypropylene and polyethylene, or denaturation thereof, natural waxes such as carnauba wax and rice wax, amide wax such as fatty acid bisamide, and the like. It is preferred that these are added as a releasing agent and are subjected to salting out/fusing together with resin or colorant as mentioned above.

In the same manner, it is possible to use various charge control agents which are known in the art and are capable of being dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof, and the like.

<Developers>

The toner may be employed as either a non-magnetic single component developer.

Photoreceptors will now be described.

Employed as an electrophotographic photoreceptor employed in image forming apparatuses may be either inorganic photoreceptors or organic photoreceptors. Of these, organic photoreceptors are more preferred due to the desired color sensitivity to laser beams employed for image exposure during formation of latent images, as well as for their high productivity.

Organic photoreceptors, as described herein, refer to electrophotographic photoreceptors which are constituted in such a manner that at least either a charge generating function or a charge transport function, which is essential for constituting electrophotographic photoreceptors, is exhibited by employing organic compounds. Example includes electrophotographic organic photoreceptors such as photoreceptors constituted employing organic charge generating materials and organic charge transport materials, as well as photoreceptors constituted so that the charge generating function and charge transport function are exhibited by polymer complexes.

In an electrophotographic photoreceptor employed in an image forming apparatus, it is preferable to improve transferability of toner from the photoreceptor to a recording paper sheet in such a manner that the photoreceptor surface exhibits such physical properties to result in low surface energy. One of the means to achieve this is that the surface layer of the photoreceptor is modified to one comprised of fluorine based resinous particles and another is that surface energy reducing agents are supplied onto the surface of the photoreceptor. By such means, the surface energy of the photoreceptor is lowered, whereby it is-possible to improve the transferability from the photoreceptor to recording paper sheets. By simultaneously lowering the surface energy of the photoreceptor and employing a group of toners which are subjected to control of the above-mentioned toner turbidity, the transfer efficiency of toner from the photoreceptor to recording paper sheets is enhanced, whereby it is possible to produce electrophotographic color images which exhibit excellent sharpness of text as well as color images, in addition to exhibiting excellent color reproduction.

Further, by lowering the surface energy of the electrophotographic photoreceptor, it is preferable that the contact angle of the surface layer to water is controlled to be least 90 degrees. By controlling the contact angle to water to at least 90 degrees, it is possible to improve the cleaning property of toner as well as the transferability of toner from the photoreceptor to intermediate transfer medium.

Listed as the above-mentioned fluorine based resinous particles may be those comprised, for example, of polytetrafluoroethylene, polyvinylidene fluoride, polyethylene trifluoride chloride, polyvinyl fluoride, polyethylene tetrafluoride-perfluoroalkyl vinyl ether copolymers, polyethylene tetrafluoride-propylene hexafluoride copolymers, polyethylene-ethylene trifluoride copolymers, or polyethylene tetrafluoride-propylene hexafluoride-fluoroalkyl vinyl ether copolymers. The volume average particle diameter is preferably 0.05-10 μm, and is more preferably 0.1-5 μm. Further, the amount of fluorine based resinous particles incorporated into a photoreceptor is preferably 0.1-90 percent by weight with respect to the binder resins of the surface layer of the photoreceptor, and is more preferably 1-50 percent by weight. When the amount is at least 0.1 percent, it is possible to provide the photoreceptor with sufficient printing longevity and lubricating property, resulting in significant improvement of the primary transferability of the above-mentioned toner. As a result, a decrease in image density rarely results and imperfect transfer as well as degradation of sharpness hardly occurs. When the amount is controlled to be at most 90 percent by weight, the surface layer is more easily prepared.

The volume average diameter (D4) of the above-mentioned fluorine based resinous particles is determined employing a laser diffraction/scattering type particle size distribution measurement apparatus "LA-700" (manufactured by Horiba, Ltd.).

Further, the surface contact angle of photoreceptors is determined as follows. Under an ambience of 20° C. and relative humidity 50 percent, contact angle to pure water is determined employing a contact angle meter (Type CA-DT.A, manufactured by Kyowa Interface Science Co., Ltd.).

Surface energy reducing agents will now be described. Surface energy reducing agents, as described herein, refer to substances which adhere to the surface of electrophotographic photoreceptors and lower their surface energy, and more specifically refer to materials which adhere to the surface, and increase the surface contact angle (being a contact angle to pure water) of electrophotographic photoreceptors at an angle of at least 1 degree.

Materials for surface energy reducing agents are not particularly limited, as long as they increase the surface contact angle (being a contact angle to pure water) of electrophotographic photoreceptors at an angle of at least 1 degree. The most preferred surface energy reducing agents are fatty acid metal salts which result in a spreading property and a uniform layer forming property to the photoreceptor surface.

The fatty acid metal salts are preferably metal salts of saturated or unsaturated fatty acids having at least 10 carbon atoms. Examples include aluminum stearate, indium stearate, gallium stearate, zinc stearate, lithium stearate, magnesium stearate, sodium stearate, aluminum palmitate, and aluminum oleate, of which metal stearate are more preferred.

Of the above-mentioned fatty acid metal salts, fatty acid metal salts, which exhibit high exit velocity of a flow tester, result in high cleavage, whereby it is possible to more effectively form a fatty acid metal salt layer on the surface of the above-mentioned photoreceptor. The exit velocity is preferably in the range of $1\times10^{-7}$-$1\times10^{-1}$ ml/sec, and is more preferably in the range of $5\times10^{-4}$-$1\times10^{-2}$ ml/sec. The exit velocity of the flow tester was determined employing Shimazdu Flow Tester "CFT-500" (manufactured by Shimadzu Corp.).

The image forming apparatus to which the invention is applied.

It is preferable that the image forming apparatus according to the image forming method of the invention comprise a toner conveying member, a toner layer regulating member and an auxiliary toner supply member, and in addition, said auxiliary toner supply member is to come into contact with said toner conveying member while said toner layer regulating member comes into contact with said toner conveying member. The non-magnetic toner is made to form a thin layer on a toner conveying member by employing the apparatus, and it is preferable that a latent image on the photoreceptor is developed by the toner having regulated thickness which is brought into contact with the photoreceptor.

The toner conveying member supplies a non-magnetic toner to an electrostatic latent image forming member, such as an electrophotographic photoreceptor. From the viewpoint of assuring sufficient development region in the state of contact with the electrostatic latent image forming member, an elastic member is preferred as said toner conveying member.

Urethane rubber or silicone rubber rollers, as well as devices in which a sponge roller is placed in the interior of an endless belt-shaped member made of nickel are preferably employed.

The toner layer regulating member exhibits functions which uniformly apply toner onto said toner conveying member and in addition which provides triboelectrification. Specifically employed as said members are elastic bodies such as urethane rubber and metal panels. The toner layer regulating member is brought into contact with said toner conveying member, whereby a thin toner layer is formed on said toner conveying member. Said thin toner layer, as described herein, refers to a layer in the state that a toner layer is comprised of at most 10 layers and preferably 5 layers or less.

The toner layer regulating member is preferably brought into contact with said toner conveying member at a pressure of 10 mN/cm to 5 N/cm, and more preferably at a pressure of 200 mN/cm to 4 N/cm, from the viewpoint of minimizing uneven conveyance as well as minimizing formation of white streaking on images due to uneven toner conveyance.

The auxiliary toner supply member is a unit to uniformly supply toner to said toner supply member. Employed as said units may be water wheel-shaped rollers fitted with stirring blades or sponge-shaped rollers. In the invention, from the viewpoint of stabilizing the toner supplying and minimizing streaking image problems, the diameter of said toner supply member is preferably in the range of 0.2 to 1.5 times the diameter of said toner conveying member.

An organic photoreceptor is preferably employed. The organic photoreceptor having a charge generation layer and a charge transfer layer.

One embodiment of the development unit 4 (a development apparatus), which is employed for the image forming method in the invention, will now be described with specific reference to FIG. 1.

Figure 1:
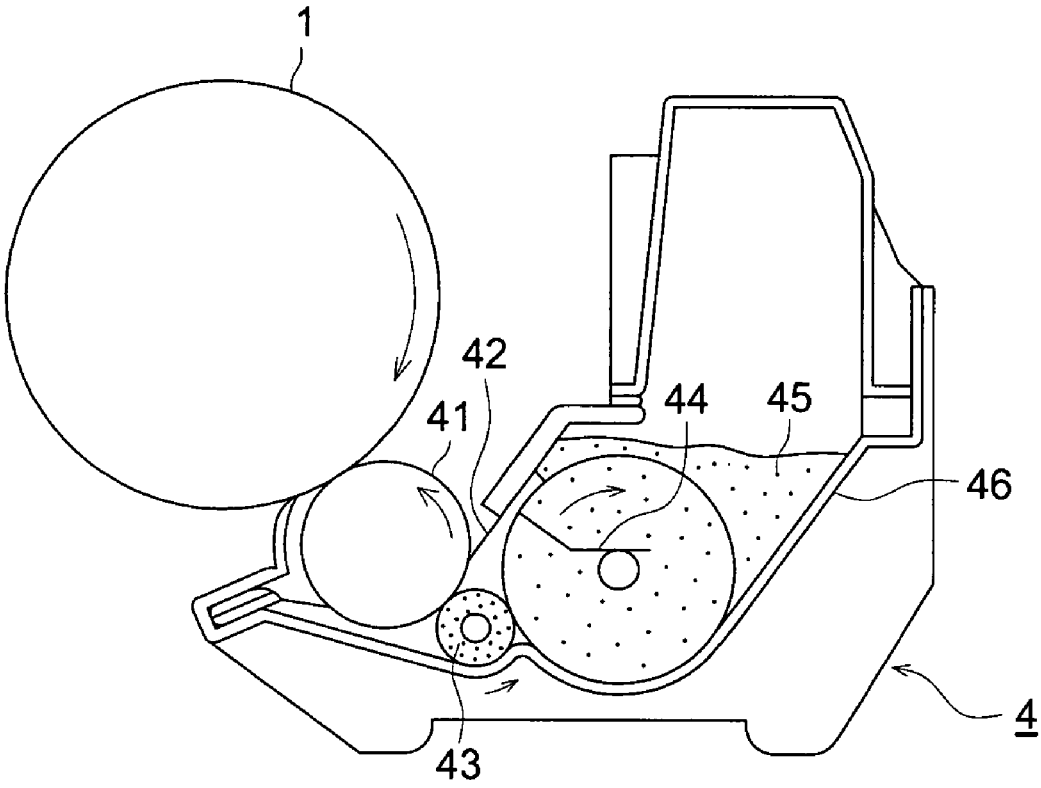
FIG. 1 shows a cross section of an example of a development unit.

FIG. 1 is a schematic cross-sectional view of a development unit employed in the image forming method of the invention.

In FIG. 1, single non-magnetic component toner 45, stored in toner tank 46, is enforcedly convey-supplied onto sponge roller 43 as an auxiliary toner supply member, employing stirring blade 44 as said auxiliary toner supply member. Toner adhered on sponge roller is conveyed onto a developing sleeve 41 made of, for example, rubber roller, being as a toner conveying member, utilizing the rotation in the arrowed direction of said sponge roller, and is electrostatically and physically adsorbed onto its surface due to friction with the developing sleeve. On the other hand, the toner adhered onto the developing sleeve, as described above, is subjected to thin uniform layering and simultaneous triboelectrification due to the rotation of the developing sleeve in the arrowed direction, as well as flexible steel blade 42 as a toner layer thickness regulating member.

The thin toner layer formed on the developing sleeve, as above, comes into contact with or approaches the surface of electrophotographic drum (a photoreceptor) 1, whereby a latent image is developed.

The image forming unit further comprises a charging member, exposing member, and a cleaning member.

FIG. 2 is a schematic view of an example of an apparatus which can be applied to the image forming method.

The color image forming apparatus is one so called as a tandem type color image forming apparatus, in which plural image forming units 10Y, 10M, 10C and 10Bk, an endless belt-shaped intermediate transferring unit 7, a paper conveying means 21 and a fixing means 24 are equipped. An original image reading device SC is arranged at the upper portion of the main body of the image forming apparatus.

The image forming unit 10Y for forming a yellow colored image has a drum-shaped photoreceptor 1Y as a primary image carrier, and a charging means 2Y, exposing means 3Y, developing means 4Y, a primary transferring roller 5Y as a primary transferring means and a cleaning means 6Y which are arranged around the photoreceptor 1Y. The image forming unit 10M for forming a magenta colored image has a drum-shaped photoreceptor 1M, and a charging means 2M, exposing means 3M, developing means 4M, a primary transferring roller 5M as a primary transferring means and a cleaning means 6M. The image forming unit 10C for forming a cyan colored image has a drum-shaped photoreceptor 1C, and a charging means 2C, exposing means 3C, developing means 4C, a primary transferring roller 5C as a primary transferring means and a cleaning means 6C. The image forming unit 10Bk for forming a black colored image has a drum-shaped photoreceptor 1Bk, and a charging means 2 Bk, exposing means 3Bk, developing means 4Bk, a primary transferring roller 5Bk as a primary transferring means and a cleaning means 6Bk.

The apparatus of FIG. 1 is applicable to each of developing members 4Y, 4M, 4C and 4Bk.

The endless belt-shaped intermediate transferring unit 7 has an endless belt-shaped intermediate transferring member 70 as a secondary image carrier which is wound on plural rollers and circulatably held.

Color images formed in the image forming units 10Y, 10M, 10C and 10Bk, respectively, are successively transferred onto the circulating endless belt-shaped intermediate transferring member 70 by the primary transferring rollers 5Y, 5M, 5C and 5Bk as the primary transferring means, thus a color image is synthesized. Paper P as a recording material (a support carrying the finally fixed image such as a plain paper sheet and a transparent sheet) stocked in a paper supplying cassette 20 is supplied by a paper supplying means 21, and conveyed to a secondary transferring roller 5A as a secondary transferring means through intermediate conveying rollers 22A, 22B, 22C and 22D and a register roller 23. Then the color image is collectively transferred by the secondary transferring onto the paper P. The color image transferred on the paper P is fixed by the fixing means 24 and conveyed by an output roller 25 to be stood on an output tray 26.

Besides, the toner remained on the endless belt intermediate transferring member 70 is removed by the cleaning means 6A after the color image is transferred to the paper P by the secondary transferring roller 5A and the paper P is separated by curvature from the intermediate transferring belt.

In the course of the image formation process, the primary transferring roller 5Bk is constantly pressed to the photoreceptor 1Bk. The other primary transferring rollers 5Y, 5M and 5C are each contacted by pressing to the corresponding photoreceptors 1Y, 1M and 1C, respectively, only for the period of image formation.

The secondary transferring roller 5A is contacted by pressing to the endless belt-shaped intermediate transferring member 70 only for the period of the secondary transferring while passing of the paper P.

A frame 8 can be pulled out from the main body A of the apparatus through supporting rails 82L and 82R.

The box 8 includes the image forming units 10Y, 10M, 10C and 10Bk, and an intermediate transferring unit 7 comprising the endless belt-shaped intermediate transferring member 70.

The image forming units 10Y, 10M, 10C and 10Bk are serially arranged in the perpendicular direction. In the drawing, the endless belt-shaped intermediate transferring unit 7 is arranged at left side of the photoreceptors 1Y, 1M, 1C and 1Bk. The endless belt-shaped intermediate transferring unit 7 included the circulatable endless belt-shaped intermediate transferring member 70 wound with the rollers 71, 72, 73 and 74, the primary transferring rollers 5Y, 5M, 5C and 5Bk, and the cleaning means 6A.

Figure 3:
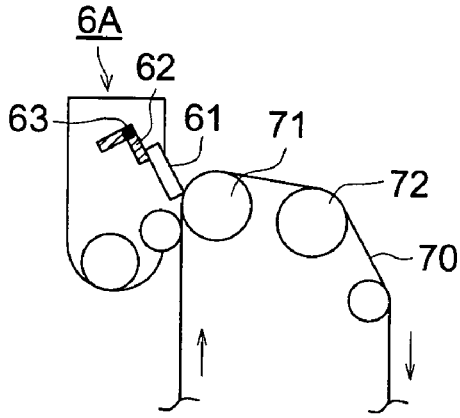
FIG. 3 shows an example of cleaning means of intermediate transferring member.

FIG. 3 illustrates an example of the cleaning means for the intermediate transferring member.

As is shown in FIG. 3, the cleaning means 6A for the intermediate transferring member is constituted by a blade 61 which is equipped to a bracket 62 which is rotatably controlled around a supporting shaft 63. The blade pressing force to the roller 71 can be controlled by varying the load by a spring or a weight.

The image forming units 10Y, 10M, 10C and 10Bk can be pulled out from the main body A together with the endless belt-shaped intermediate transferring unit 7 when the frame 8 is pulled out.

The supporting rail 82L equipped at the left side of box 8 in the drawing is positioned in the space at the upper portion of the fixing means 24. The supporting rail 82R equipped at the right side of box 8 in the drawing is arranged at the lower portion of the lowest developing means 4Bk. The supporting rail 82R is positioned so as to not obstruct the action to the developing means 4Y, 4M, 4C and 4Bk for installing into and releasing out from the box 8.

In the drawing, the right side of the photoreceptors 1Y, 1M, 1C and 1Bk is surrounded by the developing means 4Y, 4M, 4C and 4Bk, the lower portion is surrounded by the charging means 2Y, 2M, 2C and 2Bk, and the light side portion is surrounded by the endless belt-shaped intermediate transferring member 70.

In the box 8, the photoreceptor and the charging means constitute the photoreceptor unit, and one developing means and the toner supplying device constitute one developing unit.

Figure 4:
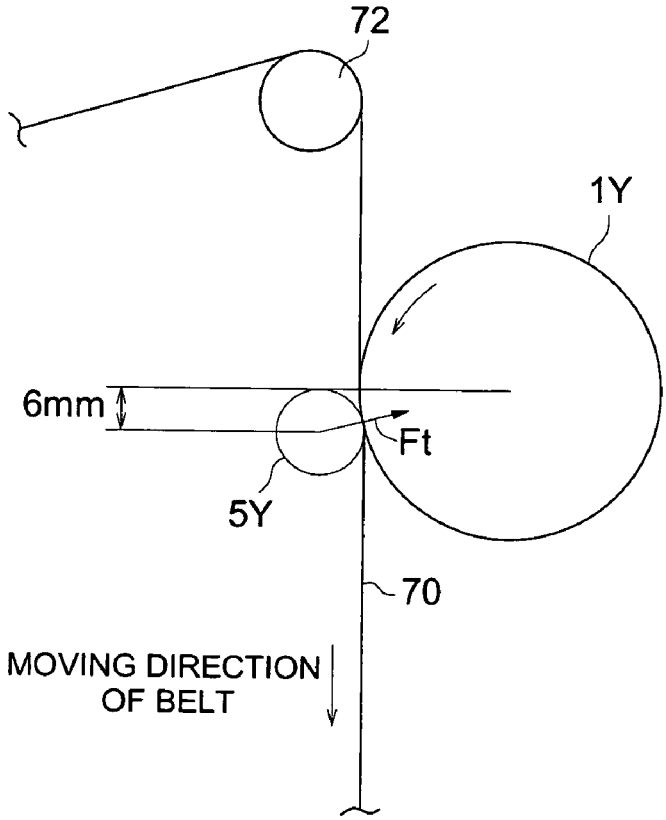
FIG. 4 shows the relational positions of a photoreceptor, an endless belt type intermediate transferring member and a primary transferring roller.

FIG. 4 is a drawing of the arrangement illustrating the relation of the positions of the endless belt-shaped intermediate transferring member and the primary transferring rollers. As is shown in FIG. 4, the primary transferring rollers 5Y, 5M, 5C and 5Bk each pushes the endless belt-shaped intermediate transferring member 70 as the intermediate transferring means from the back side to contact to photoreceptors 1Y, 1M, 1C and 1Bk, respectively. The primary transferring rollers 5Y, 5M, 5C and 5Bk are each arranged at the position being at the lower course side of each of the contact points of the photoreceptors 1Y, 1M, 1C and 1Bk with the endless belt-shaped intermediate transferring member 70, respectively, when the pressure is not applied. When the primary transferring rollers 5Y, 5M, 5C and 5Bk are each contacted by applying pressure to the photoreceptors 1Y, 1M, 1C and 1Bk, the endless belt-shaped intermediate transferring member 70 is curved along the circumference of each of the photoreceptors 1Y, 1M, 1C and 1Bk. Therefore, the primary transferring rollers 5Y, 5M, 5C and 5Bk are arranged at the lowest course of the contacting area of the endless belt-shaped intermediate transferring member 70 with the photoreceptor.

Figure 5:
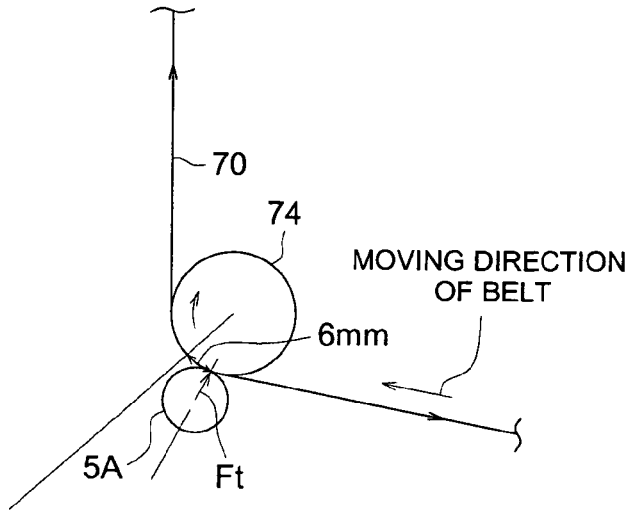
FIG. 5 shows the relational positions of an endless belt type intermediate transferring member and a secondary transferring roller.

FIG. 5 is a drawing of the arrangement illustrating the relation of the positions of the backup rollers, the endless belt-shaped intermediate transferring member and the secondary transferring roller. It is preferable that the secondary transferring roller 5A is arranged at a position being at upper course side of the rotating direction of the backup roller than the center portion of the contact area of the endless belt-shaped intermediate transferring member 70 with the backup roller 74 on the occasion of that the pressure is not applied, as is shown in FIG. 5.

A film of polymer such as polyimide, polycarbonate and PVdF and a synthesized rubber such as silicone rubber and fluorized rubber which are given electric conductivity by addition of electroconductive filler such as carbon black are usable for the intermediate transferring member. The shape of the intermediate transferring member may be either drum or belt, and the belt-shaped one is preferred from the viewpoint of the degree of freedom of the apparatus design.

It is preferable that the surface of the intermediate transferring member is suitably roughened. By making the ten point surface roughness Rz or the intermediate transferring member to 0.5 to 2 μm, it is made possible that the surface energy reducing agent supplied is taken to the surface of the intermediate transferring member so as to lower the adhesive force of the toner on the surface of the intermediate transferring member. Thus the efficiency of the secondary transfer of the toner from the intermediate transferring member to the recording material can be easily raised. In such the case, such the effect tends to be enhanced when the ten point surface roughness Rz of the intermediate transferring member is larger than that of the photoreceptor.

Methods for providing surface energy reducing agents onto the photoreceptor are not limited. For example, either method, in which surface energy reducing agents are mixed with a developing agent and the surface energy reducing agents are provided onto the photoreceptor via the resulting developing agent, or in which surface energy reducing agents are provided onto the surface of the photoreceptor employing an agent providing means, may be employed. However, in the case in which surface energy reducing agents are mixed with the developing agent, the mixing adversely affects development characteristic such as charging characteristics and fluidity of toner. As a result, sometimes, it becomes difficult to reach the sufficient mixing level. When described in terms of the relationship with toner, by mixing surface lowering agents with the developing agent, effects for minimizing the imperfect transfer and character spots tend to be markedly degraded. Due to that, a method is preferred in which the surface energy reducing agents are provided onto the surface of electrophotographic photoreceptor employing an agent providing means.

It is preferable to arrange the agent providing means in the appropriate position around the electrophotographic photoreceptor. In order to effectively utilize the arrangement space, the arrangement may be carried out utilizing one portion of the charging means, the development means, and the cleaning means described in FIG. 2. An example follows in which the agent providing means and the cleaning means are simultaneously employed.

Figure 6:
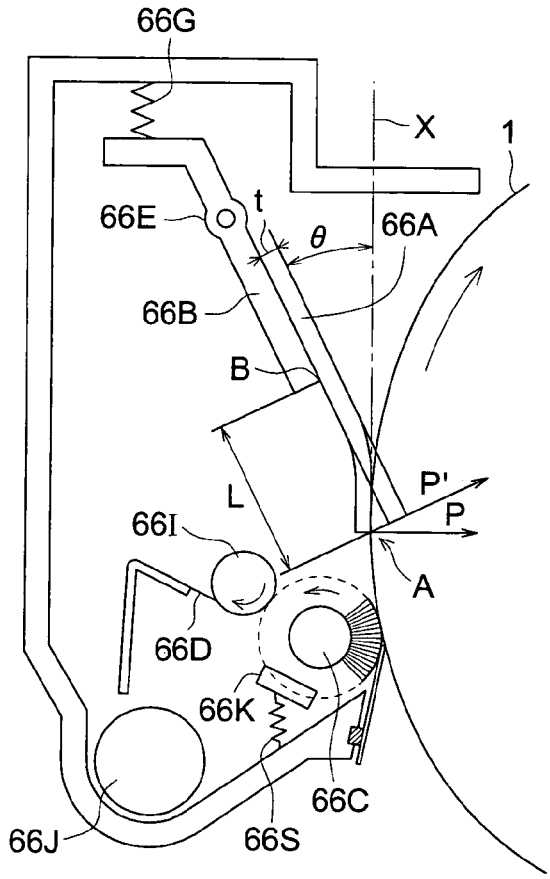
FIG. 6 shows the constitution of cleaning means to be installed with the photoreceptor according to the invention.

FIG. 6 is a constitution view of a cleaning means capable of being arranged in an image forming apparatus.

The cleaning means is employed as cleaning means 6Y, 6M, 6C or 6Bk in FIG. 2. Cleaning blade 66A in FIG. 6 is attached to holding member 66B. An elastic rubber body is employed as the material for the cleaning blade. Known as such materials are urethane rubber, silicone rubber, fluorine rubber, chloroprene rubber, and butadiene rubber. Of these, urethane rubber is particularly preferred due to its excellent abrasion resistance compared to other kinds of rubber.

Holding member 66B is comprised of a plate shaped metal or plastic member. Preferred as the metal member is a stainless steel plate, an aluminum plate, or a vibration damping steel plate.

The end portion of the cleaning blade, which is brought into pressure contact with a photoreceptor surface is preferably brought into pressure contact with the same in the direction opposite (being counter-direction) to the rotation of the photoreceptor under an application of load. As shown in FIG. 6, when the end portion of the cleaning blade is brought into pressure contact with the photoreceptor, it is preferable that a pressure contact plane is formed.

The preferred values of contact load P and contact angle θ of the cleaning blade to the photoreceptor are 5-40 N/m and 5-35 degrees, respectively.

Contact load P represents the vector value of pressure contact force P' in the normal direction when cleaning blade 16A is brought into contact with photoreceptor drum 10.

Contact angle θ represents the angle of tangent line X to the blade prior to blade deformation at contact point A. 66E is a rotation shaft which allows the holding member to rotate, while 66G represents a load spring.

As shown in FIG. 6, free length L of the cleaning blade represents the distance from the position of end portion B of holding member 66B to the end point of the blade prior to deformation. The preferred value of the free length L is 6-15 mm. Thickness t of the cleaning blade is preferably 0.5-10 mm. Thickness of the cleaning blade, as described herein, refers to the thickness in the perpendicular direction with respect to the adhesion plane of holding member 66B.

Employed as a cleaning means in FIG. 6 is brush roller 66C which also functions as an agent providing means. The brush roller exhibits functions for removing toner adhered onto photoreceptor 1, and recovering the toner which has been removed by cleaning blade 66A, and in addition, exhibits functions as an agent providing means which provides surface energy reducing agents to the photoreceptor. Namely, the brush roller comes into contact with photoreceptor 1, and at the contact position, rotates in the same direction as the photoreceptor, removing toner and paper dust on the photoreceptor, and simultaneously conveys the toner, removed by cleaning blade 66A to conveying screw 66J, for recovery. In this channel, it is preferable that by bringing flicker 66I as a removing means into contact with brush roller 66C, materials which have been transferred from photoreceptor 1 to brush roller 66C are removed. Further, the toner adhered onto the flicker is removed employing scraper 66D, and is conveyed to conveying screw 66J for recovery. The recovered toner is ejected to the exterior as waste or is conveyed to the development unit via a recycle pipe (not shown) for recycling toner and reused. Preferably employed as materials for flicker 66I are metal tubes made of stainless steel and aluminum. On the other hand, employed as scraper 66D are elastic plates such as a phosphor bronze plate, a polyethylene terephthalate plate, or a polycarbonate plate. It is preferable that the end is brought into contact employing a counter system which forms an acute angle with respect to the flicker rotation.

Surface energy reducing agent 66K such as a solid element comprised of zinc stearate, is attached while pressed with spring load 16S. The brush rubs the surface energy reducing agent while rotating and provides the surface energy reducing agent onto the photoreceptor surface.

Employed as brush roller 66C is an electrically conductive or semi-conductive brush roller.

Employed as components for constituting the brush roller are any which are suitable. However, it is preferable to use fiber forming high-molecular weight polymers which are hydrophobic at a relatively high dielectric constant. Listed as such polymers are, for example, rayon, nylon, polycarbonate, polyester, methacrylic acid resins, acrylic acid resins, polyvinyl chloride, polyvinylidene chloride, polypropylene, polystyrene, polyvinyl acetate, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol formaldehyde resins, styrene-alkyd resins, and polyvinyl acetal (e.g. polyvinyl butyral). These binder resins may be employed individually or in combinations of at least two types. Particularly preferred are rayon, nylon, polyester, acryl resins, and polypropylene.

Further, employed as the above-mentioned brush is one which is electrically conductive or semi-conductive. It is possible to use a brush of which specific resistance is controlled to a specified value by incorporating low resistant materials such as carbon into the components.

The specific resistance of the bristles of the brush roller is preferably in the range of $10^1$-$10^6$ Ωcm when determined in such a state that at normal temperature and humidity (26° C. and 50 percent relative humidity), voltage at 500 V is applied to both ends of a 10 cm long bristle.

Namely, it is preferable that the brush roller is comprised of a core material such as stainless steel and electrically conductive or semi-conductive bristles at a specific resistance of $10^1$-$10^6$ Ωcm. By maintaining the specific resistance in this range, it is possible to minimize banding and the like due to discharge, and increase electric potential difference with the photoreceptor, whereby it is possible to maintain desirable cleaning properties.

The thickness of one bristle employed in the brush roller is preferably 5-20 denier. When the thickness is at least 5 denier, sufficient abrasion force can be applied, whereby it is possible to remove materials adhered onto the surface. When the thickness is at most 20 denier, the resulting brush exhibits suitable stiffness, whereby without scratching the photoreceptor surface, abrasive wear is minimized to extend the life of the photoreceptor.

Denier, as described herein, is the numerical value, as g (gram) unit, which is obtained by weighing a 9,000 m long bristle which constitutes the above-mentioned brush.

The bristle density (being the number of bristles per square centimeter) of the above-mentioned brush is $4.5\times10^2$-$2.0\times10^4$ per $cm^2$. By setting the density in the above range, the resulting stiffness becomes appropriate whereby it is possible to suitably control abrasion force. As a result, abrasion is uniformly carried out to make it possible to uniformly remove adhered materials and minimize abrasion and wear of the photoreceptor, whereby it is possible to minimize formation of poor images resulting in background staining due to a decrease in speed as well as black streaks due to scarring.

The penetrating length of the brush roller to the photoreceptor is preferably set at 0.4-1.5 mm, and more preferably at 0.5-1.2 mm. The above penetrating length relates to a load applied to the brush which is generated by the relative movement of the photoreceptor drum and the brush roller. When viewed from the photoreceptor drum, the above load is equivalent to abrasion force resulted by the brush. Consequently, specifying its range means that it is more suitable that a photoreceptor is abraded by suitable force.

Penetrating length, as described herein, refers to the penetrating length into the interior of the photoreceptor under the assumption that when the brush is brought into contact with the photoreceptor, bristles of the brush are not curved on the photoreceptor surface but linearly penetrate into its interior.

The photoreceptor, onto which the surface energy reducing agent is provided, results in smaller abrasion force on the photoreceptor surface to the brush. As a result, when the penetrating length is in the above-mentioned range, it is possible to minimize filming due to toner as well as paper dust on the photoreceptor surface, whereby it is possible to minimize formation of non-uniformity of images. Further, the abraded amount of the photoreceptor is reduced, whereby it is possible to minimize formation of background stain due to a decrease in speed as well as formation streaking problems of images due to scarring on the photoreceptor surface.

Mainly employed as a core of the roller are metals such as stainless steel or aluminum, as well as paper and plastics.

It is preferable that the brush roller is constituted in such a manner that a brush is arranged on the surface of a cylindrical core material via an adhesion layer.

It is preferable that the contact portion of the brush roller rotates so as to move in the same direction as the photoreceptor surface. When the above contact portions are allowed to move in the same direction, it is possible to minimize stain formed on recording paper sheets as well as in the apparatus due to spilled toner which has been removed employing the brush roller when excessive toner is present on the photoreceptor surface.

In the case in which, as noted above, the photoreceptor and the brush roller move in the same direction, the ratio of the surface rate between both is preferably in the range of 1:1.1-1:2. By controlling the ratio in the above range, it is possible to maintain the desired toner removing capability of the brush roller. As a result, it is possible to minimize insufficient cleaning, as well as blade bounding and under-curl.

EXAMPLE

The specific embodiments of the present invention will now be described.

Preparation of Developing Agents

Preparation of Toners and Developing Agents (Preparation of Toners 1Bk, 1Ya, 1Yb, 1M, and 1C)

Charged into 10.0 liters of pure water was 0.90 kg of sodium n-dodecylsulfate and dissolved while stirring. Gradually added to the resulting solution was 1.20 kg of Regal 330R (carbon black prepared by Cabot Corp.). After vigorous stirring for one hour, the resulting mixture was continuously dispersed over 20 hours employing a sand grinder (being a medium type homogenizer). The resulting. dispersion was designated as "Colorant Dispersion 1".

A solution comprised of 0.055 kg of sodium dodecylbenzenesulfonate and 4.0 liters of ion-exchange water was designated as "Anionic Surface Active Agent Solution A".

A solution comprised of 0.014 kg of nonylphenol polyethylene oxide 10 mol addition product and 4.0 liters of ion-exchange water was designated as "Nonionic Surface Active Agent Solution B".

A solution prepared by dissolving 223.8 g of potassium persulfate in 12.0 liters of ion-exchange water was designated as "Initiator Solution C".

Charged into a 100-liter GL (glass-lining) reaction tank fitted with a thermal sensor, a cooling pipe, and a nitrogen inletting unit were 3.41 kg of a wax emulsion (being a number average molecular weight 3,000 polypropylene emulsion at a number average primary particle diameter of 120 nm and a solid concentration of 29.9 percent), all the "Anionic surface active agent Solution A", and all the "Nonionic surface active agent Solution B", and the resulting mixture was stirred. Subsequently, added was 44.0 liters of ion-exchange water.

Subsequently, the resulting mixture was heated. When the liquid composition was heated to 75° C., all the "Initiator Solution C" was added drop by drop. Thereafter, while controlling the temperature of the liquid composition at 75±1° C., 12.1 kg of styrene, 2.88 kg of n-butyl acrylate, 1.04 kg of methacrylic acid, and 548 g of t-dodecylmercaptan were added by dripping. After dripping, the resulting mixture was heated to 80±1° C. and stirred for 6 hours while maintaining the temperature. Subsequently, the liquid composition was cooled to 40° C. or-below, and stirring was terminated. The resulting composition was filtered employing a pare filter, whereby a latex was prepared which was designated as "Latex A".

The glass transition temperature of resinous particles in Latex A was 57° C., and its softening point was 121° C., while with regard to its molecular weight distribution, the weight average molecular weight and the weight average particle diameter were 12,700 and 120 nm, respectively.

A solution in which 0.055 kg of sodium dodecylbenzenesulfonate was dissolved in 4.0 liters of ion-exchange water was designated as "Anionic Surface Active Agent Solution D".

Further, a solution in which 0.014 kg of nonylphenol polyethylene oxide 10 mol addition product was dissolved in 4.0 liters of ion-exchange water was designated as "Nonionic Surface Active Agent Solution E".

A solution in which 200.7 kg of potassium persulfate (manufactured by Kanto Kagaku) was dissolved in 12.0 liters of ion-exchange water was designated as "Initiator Solution F".

Charged into a 100-liter GL reaction tank fitted with a thermal sensor, a cooling pipe, a nitrogen inletting unit, and a comb-shaped baffle were 3.41 kg of a WAX emulsion (being a number average molecular weight 3,000 polypropylene emulsion at a number average primary particle diameter of 120 nm and a solid concentration of 29.9 percent), all the "Anionic Surface Active Agent Solution D", and all the "Nonionic surface active Agent Solution E", and the resulting mixture was stirred.

Subsequently, charged was 44.0 liters of ion-exchange water. The resulting mixture was heated, and when the liquid composition reached 75° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added by dripping. After completion of the dripping, the resulting liquid composition was heated to 72±2° C., and stirred for 6 hours while maintaining the above temperature. Further, the temperature of the liquid composition was raised to 80±2° C. and stirred for 12 hours while maintaining the above temperature. Subsequently, the liquid composition was cooled to at least 40° C., and stirring was terminated. The resulting composition was filtered employing a pore filter, whereby a latex was prepared which was designated as "Latex B".

Incidentally, the glass transition temperature of resinous particles in Latex B was 58° C., and its softening point was 132° C., while with regard to its molecular weight distribution, the weight average molecular weight and the weight average particle diameter were 245,000 and 110 nm, respectively.

A solution in which 5.36 kg of sodium chloride as a salting-out agent was dissolved in 20.0 liters of ion-exchange water was designated as "Sodium Chloride Solution G".

A solution in which 1.00 g of a fluorine based nonionic surface active agent was dissolved in 1.00 liter of ion-exchange water was designated as "Nonionic Surface Active Agent Solution H".

While stirring, charged into a 100-liter SUS reaction tank fitted with a thermal sensor, a cooling pipe, a nitrogen inletting unit, and a particle diameter and shape monitoring unit were 20.0 kg of Latex A, and 5.2 kg of Latex B, prepared as above, as well as 0.4 kg of Colorant Dispersion 1 and 20.0 kg of ion-exchange water. Subsequently, the resulting mixture was heated to 40° C., and Sodium Chloride Solution G, 6.00 kg of isopropanol (manufactured by Kanto Kagaku), and Nonionic Surface Active Agent Solution H were added in the above order. Thereafter, the resulting mixture was allowed to stand for 10 minutes, and then heated to 85° C. over a period of 60 minutes. Subsequently, while maintained at 85±2° C., particles were allowed to grow while stirring for 0.5-3 hours while being subjected to salting-out/fusion (being a salting-out/fusion process). Subsequently, 2.1 liters of pure water was added to terminate the growth of the particles, whereby a fused particle dispersion was prepared.

Charged into a 5-liter reaction vessel fitted with a thermal sensor, a cooling pipe, and a particle diameter and shape monitoring unit, was 5.0 kg of the fused particle dispersion prepared as above. Subsequently, the above dispersion was stirred at 85±2° C. for 0.5-15 hours, whereby the shape was controlled (being a shape control process). Thereafter, the resulting dispersion was cooled to at most 40° C. and stirring was terminated. Subsequently, by employing a centrifuge, classification was carried out in the liquid composition employing a centrifugal sedimentation method, and filtered employing an opening 45 μm sieve. The resulting filtrate was designated as a coalescence liquid composition. Subsequently, by employing a filter, non-spherical particles were collected from the above coalescence liquid composition via filtration, and thereafter, were washed with ion-exchange water. The resulting non-spherical particles were dried at an air suction temperature of 60° C. employing a drier and subsequently dried at 60° C., employing a fluid layer drier. Added to 100 parts by weight of the resulting colored particles were 0.5 part by weight of hydrophobic silica (at a hydrophobicity of 75 and a number average primary particle diameter of 12 nm) and 0.25 part by weight of 0.05 μm titanium oxide. The resulting mixture was mixed at 52° C. for 10 minutes at a Henschel mixer peripheral rate 40 m/second, whereby "Toner 1Bk" was prepared.

"Toner 1Ya" was prepared in the same manner as Toner 1Bk, except that carbon black was replaced with C.I. Pigment Yellow 185. Further, "Toner 1Yb" was prepared while decreasing the peripheral rate of the Henschel mixer.

"Toner 1M" was prepared in the same manner as Toner 1Bk, except that carbon black was replaced with C.I. Pigment Red 122.

"Toner 1C" was prepared in the same manner as Toner 1Bk, except that carbon black was replaced with C.I. Pigment Blue 15:3. Table 1 shows measurement results of number average particle diameter and $M(m_1+m_2)$ of Toners 1Bk, 1Ya, 1M, and 1C, while Table 2 shows the measurement results of toner turbidity. Further, the number average particle diameter and $M(m_1+m_2)$ of Toner 1Yb were almost same as for Toner 1Ya.

(Preparation of Toners 2Bk, 2Ya-2Yf, 2M, and 2C)

Toners 2Bk, 2Ya-2Yf, 2M, and 2C were prepared in the same manner as above-mentioned Toners 1Bk, 1Y, 1M, and 1C, except that the hydrophobic silica (at a hydrophobicity degree of 75 and a number average primary particle diameter of 12 nm) was replaced with hydrophobic silica (at a hydrophobicity degree of 77 and a number average primary particle diameter of 20 nm), and the peripheral rate and the duration of the Henschel mixer were varied. Table 2 shows the measurement results of turbidity of. Toners 2Bk, 2Ya-2Yf, 2M, and 2C. Incidentally, the number average particle diameter and $M(m_1+m_2)$ of these toners were almost the same as the measurement results (toner number average particle diameter and $M(m_1+m_2)$) of toners which correspond to each color of Toners 1Bk, 1Ya, 1M, and 1C.

(Preparation of Toners 3Bk, 3Ya-3Yd, 3M, and 3C)

Toners 3Bk, 3Ya-3Yd, 3M, and 3C were prepared in the same manner as above-mentioned Toners 1Bk, 1Y, 1M, and 1C, except that 0.5 part by weight of the hydrophobic silica (at a hydrophobicity degree of 75 and a number average primary particle diameter of 12 nm) was varied to 1.8 parts by weight, and the peripheral rate and the mixing duration of the Henschel mixer were varied. Table 2 shows the measurement results of turbidity of Toners 3Bk, 3Ya-3Yd, 3M, and 3C. Incidentally, the number average particle diameter and $M(m_1+m_2)$ of these toners were almost the same as the measurement results of toners which basically correspond to each color of Toners 1Bk, 1Ya, 1M, and 1C.

(Preparation of Toners 4Bk, 4Ya-4Yc, 4M, and 4C)

Toners 4Bk, 4Ya-4Yc, 4M, and 4C were prepared in the same manner as above-mentioned Toners 1Bk, 1Y, 1M, and 1C, except that 0.5 part by weight of the hydrophobic silica (at a degree of hydrophobicity of 75 and a number average primary particle diameter of 12 nm) was varied to 1.8 parts by weight of the hydrophobic silica (at a hydrophobicity degree of 77 and a number average primary particle diameter of 20 nm) and the peripheral rate and the mixing duration of the Henschel mixer were varied. Table 2 shows the measurement results of turbidity of Toners 4Bk, 4Ya-4Yc, 4M, and 4C. The number average particle diameter and $M(m_1+m_2)$ of these toners were almost same as the measurement results of toners which basically correspond to each color of Toners 1Bk, 1Ya, 1M, and 1C.

(Preparation of Toners 5Bk, 5Y, 5Ma-5Mc, and 5C)

Toners 5Bk, 5Y, 5Ma-5Mc, and 5C were prepared in the same manner as above-mentioned Toners 1Bk, 1Y, 1M, and 1C, except that 0.5 part by weight of the hydrophobic silica (at a hydrophobicity degree of 75 and a number average primary particle diameter of 12 nm) was varied to 3.3 parts by weight and the peripheral rate and the mixing duration of the Henschel mixer were varied. Table 2 shows the measurement results of turbidity of Toners 5Bk, 5Y, 5Ma-5Mc, and 5C. Incidentally, the number average particle diameter and $M(m_1+m_2)$ of these toners were almost same as the measurement results of toners which basically correspond to each color of Toners 1Bk, 1Ya, 1M, and 1C.

(Preparation of Toners 6Bk, 6Y, 6M, and 6Ca-6Cc)

Toners 6Bk, 6Y, 6M, and 6Ca-6Cc were prepared in the same manner as above-mentioned Toners 1Bk, 1Y, 1M, and 1C, except that the peripheral rate and the mixing duration of the Henschel mixer were varied. Table 2 shows the measurement results of turbidity of Toners 6Bk, 6Y, 6M, and 6Ca-6Cc. Incidentally, the number average particle diameter and $M(m_1+m_2)$ of these toners were almost same as the measurement results of toners which basically correspond to each color of Toners 1Bk, 1Ya, 1M, and 1C.

The obtained toners were used for a non-magnetic single component developer for evaluation test.

TABLE 1

| Toner No. | Number Average Particle Diameter of Toner Particles (μm) | $M(m_1 + m_2)$ (%) |
|---|---|---|
| 1Bk | 5.6 | 80.7 |
| 1Ya | 5.7 | 78.8 |
| 1M | 5.6 | 81.3 |
| 1C | 5.6 | 80.3 |

(Preparation of Photoreceptors)

Photoreceptors employed in the examples above were prepared as described below. Four or more photoreceptor samples were prepared for use of each four color image forming units.

Preparation of Photoreceptor 1

The interlayer liquid coating composition, described below, was prepared and applied onto a cleaned cylindrical aluminum substrate employing a dip coating method, whereby an interlayer at a dried layer thickness of 0.3 μm was formed.

<Interlayer (UCL) Liquid Coating Composition>

| | |
|---|---|
| Polyamide resins (Amilan CM-8000, manufactured by Toray Co., Ltd.) | 60 g |
| Methanol | 1600 ml |

The liquid coating composition components, described below, were mixed and the resulting mixture was dispersed for 10 hours employing a sand mill, whereby a charge generating layer liquid coating composition was prepared. The resulting liquid coating composition was applied onto the above-mentioned interlayer, employing a dip coating method, whereby a charge generating layer at a dried layer thickness of 0.2 μm was formed.

<Charge Generating Layer (CGL) Liquid Coating Composition>

| | |
|---|---|
| Y type titanyl phthalocyanine (at a maximum peak angle of 27.3 at 2θ of X-ray diffraction by Cu—Kα) | 60 g |
| Silicone resin solution (KR5240, 15% xylene-butanol solution, manufactured by Shin-Etsu Chemical Co., Ltd. | 700 g |
| 2-Butanone | 2000 ml |

TABLE 2

| | Developer Bk No. (Toner Bk No.) | | Developer Y No. (Toner Y No.) | | Developer M No. (Toner M No.) | | Developer C No. (Toner C No.) | | Turbidity difference |
|---|---|---|---|---|---|---|---|---|---|
| Combination No | Toner No. | Turbidity | Toner No. | Turbidity | Toner No. | Turbidity | Toner No. | Turbidity | (Maximum – Minimum) |
| 1 | 1Bk | 6.2 | 1Ya | 10.3 | 1M | 6.6 | 1C | 6.4 | 4.1 |
| 2 | 1Bk | 6.2 | 1Yb | 11.4 | 1M | 6.6 | 1C | 6.4 | 5.2 |
| 3 | 2Bk | 12.5 | 2Ya | 18.3 | 2M | 12.0 | 2C | 11.3 | 7.0 |
| 4 | 2Bk | 12.5 | 2Yb | 22.1 | 2M | 12.0 | 2C | 11.3 | 10.8 |
| 5 | 2Bk | 12.5 | 2Yc | 35.3 | 2M | 12.0 | 2C | 11.3 | 24.0 |
| 6 | 2Bk | 12.5 | 2Yd | 46.0 | 2M | 12.0 | 2C | 11.3 | 34.7 |
| 7 | 2Bk | 12.5 | 2Ye | 55.1 | 2M | 12.0 | 2C | 11.3 | 43.8 |
| 8 | 2Bk | 12.5 | 2Yf | 58.3 | 2M | 12.0 | 2C | 11.3 | 47.0 |
| 9 | 3Bk | 18.5 | 3Ya | 33.4 | 3M | 19.3 | 3C | 23.8 | 14.9 |
| 10 | 3Bk | 18.5 | 3Yb | 46.0 | 3M | 19.3 | 3C | 23.8 | 27.5 |
| 11 | 3Bk | 18.5 | 3Yc | 56.8 | 3M | 19.3 | 3C | 23.8 | 38.3 |
| 12 | 3Bk | 18.5 | 3Yd | 63.3 | 3M | 19.3 | 3C | 23.8 | 44.8 |
| 13 | 4Bk | 22.3 | 4Ya | 33.8 | 4M | 29.3 | 4C | 30.5 | 11.5 |
| 14 | 4Bk | 22.3 | 4Yb | 55.6 | 4M | 29.3 | 4C | 30.5 | 33.3 |
| 15 | 4Bk | 22.3 | 4Yc | 62.2 | 4M | 29.3 | 4C | 30.5 | 39.9 |
| 16 | 5Bk | 31.5 | 5Y | 35.6 | 5Ma | 33.2 | 5C | 44.7 | 13.2 |
| 17 | 5Bk | 31.5 | 5Y | 35.6 | 5Mb | 55.1 | 5C | 44.7 | 23.6 |
| 18 | 5Bk | 31.5 | 5Y | 35.6 | 5Mc | 63.3 | 5C | 44.7 | 31.8 |
| 19 | 6Bk | 6.4 | 6Y | 7.3 | 6M | 5.3 | 6Ca | 12.1 | 6.8 |
| 20 | 6Bk | 6.4 | 6Y | 7.3 | 6M | 5.3 | 6Cb | 23.4 | 18.1 |
| 21 | 6Bk | 6.4 | 6Y | 7.3 | 6M | 5.3 | 6Cc | 52.4 | 47.1 |

The liquid coating composition components, described below, were mixed and dissolved, whereby a charge transport layer liquid coating composition was prepared. The resulting liquid coating composition was applied onto the above-mentioned charge generating layer, employing a dip coating method, whereby, a charge transports layer at a layer thickness of 20 μm was formed.

(Charge Transport Layer (CTL) Liquid Coating Composition)

| | |
|---|---|
| Charge transport material (4-methoxy-4'-(4-methyl-α-phenylstyryl)triphenylamine | 200 g |
| Bisphenol Z type polycarbonate (IUPILON Z300, Mitsubishi Gas Chemical Co., Inc.) | 300 g |
| Hindered amine (Sanol LS2626, manufactured by SANKYO Co., Ltd.) | 3 g |
| 1,2-Dichloroethane | 2000 ml |

Preparation of Photoreceptor 2

Photoreceptor 2 was prepared in the same manner as Photoreceptor 1 until coating of the charge transport layer.

<Surface Protective Layer>

| | |
|---|---|
| Charge transport material (4-methoxy-4'-(4-methyl-α-phenylstyryl)triphenylamine | 200 g |
| Bisphenol Z type polycarbonate (IUPILON Z300, Mitsubishi Gas Chemical Co., Inc.) | 300 g |
| Hindered amine (Sanol LS2626, manufactured by SANKYO Co., Ltd.) | 3 g |
| Colloidal silica (30% methanol solution) | 8 g |
| Polytetrafluoroethylene resinous particles (at an average particle diameter of 0.5 μm) | 100 g |
| 1-Butanol | 50 g |

were mixed and dissolved, whereby a surface protective layer liquid coating composition was prepared. The resulting liquid coating composition was applied onto the above-mentioned charge transport layer, employing a dip coating method and the resulting coating was subjected to thermal curing at 100° C. for 40 minutes, whereby a protective layer at a dried layer thickness of 4 μm was formed. Photoreceptor 2 was thus prepared.

Example 1

Example Employing Photoreceptor 2 Comprising Fluorine Based Resinous Particles in the Surface Layer <Evaluation>

In each of the examples and comparative examples, the color digital copier, which comprised each of the development means of Y (yellow), magenta (M), C (cyan), and Bk (black) as shown in FIG. 1 and the intermediate transfer medium shown in FIG. 2, was loaded with a developing agent group (a toner group) under the combinations shown in Table 2. At normal temperature and normal humidity (20° C. and 50 percent relative humidity), 10,000 sheets were printed while employing, as an original image document, a A 4 size image comprised of a white portion, Bk, Y, M, and C solid image portions, a text image portion, and a halftone image portion, and then evaluated. Evaluation items, evaluation methods, and evaluation criteria are described below.

Toner Dots Near Characters

A text image was formed of which toner dots near characters were observed directly and through the use of a hand magnifying lens at a magnification factor of 20 and evaluated based on the criteria below.

A: no toner dots near characters were noted through the use of hand magnifying lens (rated as good)

B: toner dots near characters were not noted directly but noted through the use of a hand magnifying lens (rated as commercially viable)

C: toner dots near characters were noted directly, and sharpness of characters were degraded (rated as commercially unviable)

Imperfect Transfer

A halftone image at a density of 0.4 was formed on both sides of a transfer paper sheet (at a basic weight of 200 g/m$^2$), and white spots due to imperfect transfer were visually evaluated.

A: no imperfect transfer was noted (rated as excellent)

B: 1-2 white spots due to imperfect transfer were noted only on the reverse side of the images of 100 sheets (rated as good)

C: 1-4 white spots due to imperfect transfer were noted on images of 50 sheets, however white spots were noticeable only when carefully observed (rated as commercially viable)

D: at least 5 white spots were noted on images of 50 sheets irrespective of the obverse or reverse side (rated as commercially unviable)

Black Spots

The number of black spots (strawberry-shaped spot images) on the halftone image per A4 size of which cycle matched that of the photoreceptor was recorded.

A: black spots of at least 0.4 mm were at most 3 per A4 sheet in all the copied images (rated as good)

B: in one or more sheets 4-15 black spots of at least 0.4 mm were formed per A4 sheet (rated as commercially viable)

C: in one or more sheets, at least 16 black spots of al least 0.4 mm were formed per A4 sheet (rated as commercially unviable)

Image Density

Image density was determined as follows. The relative reflection density of the solid image portion of each color was measured employing a densitometer "RD-918" (manufactured by Macbeth Corp.) while using the density of an unprinted recording paper sheet as zero.

A: density of each of the Bk, Y, M, and C solid image portions was at least 1.2 (rated as good)

B: density of each of the Bk, Y, M, and C solid image portions was at least 0.8 (rated as commercially viable)

C: density of each of the Bk, Y, M, and C solid image portions was less than 0.8 (rated as commercially unviable)

(Sharpness)

Image sharpness was evaluated as follows. At an ambience of low temperature and low humidity (10° C. and 20 percent relative humidity) as well as high temperature and high humidity (30° C. and 80 percent relative humidity), images were printed and lack of character detail was evaluated. Text images of 3-point and 5-point were printed, and evaluation was carried out based on the criteria below.

A: images of 3-point and 5-point were clear which were easily readable

B: images of 3-point were partly not readable, while images of 5-point were clear and easily readable C: image of 3-point were hardly readable, while images of 5-point were partly or wholly not readable Process Conditions of Digital Copier having an intermediate transferring member:

Image forming line Speed L/S: 160 mm/Second

Charging conditions of Photoreceptor (60 mmϕ): Photoreceptor surface potential in the development section was controlled within −500 V to −900V, and the surface potential was controlled within −50V.

Image exposure light: semiconductor laser (wavelength: 780 nm)

Intermediate transfer medium: A seam less endless belt intermediate transfer medium 70, having a volume electrical resistivity of $1\times10^8$ Ω·cm and Rz of 0.9 μm, made of semiconductive resin Primary transferring condition Primary transferring roller, 5Y, 5M, 5C and 5Bk shown in FIG. 1 each having a diameter of 6.05 mm. The roller constituted by a metal core and covered with elastic rubber which had a surface resistivity of $1\times10^6$ Ω·cm, and transferring potential was applied to the roller.

Secondary transferring condition

The backup roller 74 and the secondary transferring roller 5A were arranged at the both sides of the endless belt-shaped intermediate transferring member 70. In such the system, the resistivity of the backup roller 74 was $1\times10^6$ Ω·cm and that of the secondary transferring roller as the secondary transferring means was $1\times10^6$ Ω·cm and the electric current through the roller was constantly controlled at about 80 μA.

The fixing was performed by a thermal fixing system using the fixing roller, interior of which a heater was equipped. The distance Y from the initial contact point of the intermediate transferring member with the photoreceptor to the initial contact point of the intermediate transferring member with the next photoreceptor was 95 mm.

The circumference length of the driving roller 71, the guide rollers 72 and 73, and the backup roller for the secondary transferring were each 31.67 mm (=95 mm/3) and that of the tension roller 76 was 23.75 mm (=95 mm/4).

The circumference length of the primary transferring roller was 19 mm (=95 mm/5).

Cleaning condition of the photoreceptor

Cleaning blade: A urethane rubber blade was touched to the photoreceptor in the counter direction to the rotating direction of the photoreceptor.

Cleaning condition of the intermediate transferring member

Cleaning blade: A urethane rubber blade was touched to the intermediate transferring member in the counter direction to the running direction of the intermediate transferring member.

Table 3 shows the results.

TABLE 3

| Developer Group (Toner Group) No. | Toner Dots near Characters | Imperfect Transfer | Black Spots | Image Density | Sharpness |
|---|---|---|---|---|---|
| 1 | B | D | B | C | C |
| 2 | A | C | B | B | B |
| 3 | A | C | A | B | A |
| 4 | A | A | A | A | A |
| 5 | A | A | A | A | A |
| 6 | A | B | B | A | A |
| 7 | A | B | B | A | B |
| 8 | C | C | B | B | C |
| 9 | A | A | A | A | A |
| 10 | A | A | B | A | A |
| 11 | A | B | B | A | B |
| 12 | B | C | C | B | C |
| 13 | B | B | A | A | A |
| 14 | B | B | B | A | A |

TABLE 3-continued

| Developer Group (Toner Group) No. | Toner Dots near Characters | Imperfect Transfer | Black Spots | Image Density | Sharpness |
|---|---|---|---|---|---|
| 15 | C | C | C | B | C |
| 16 | B | B | B | A | A |
| 17 | B | B | B | A | A |
| 18 | C | C | C | C | C |
| 19 | A | C | B | B | B |
| 20 | A | A | A | A | A |
| 21 | C | D | B | B | C |

As seen be seen from Table 3, developing agent groups which satisfied the requirements for the present invention, namely developing agent groups (Nos. 2, 3, 4, 5, 6, 7, 9, 10, 11, 13, 14, 16, 17, 19, and 20) in which the maximum turbidity difference of toners of each color was in the range of 5-45, resulted in commercially viable evaluation for toner dots near character, imperfect transfer, black spots, image density, and sharpness. On the other hand, in developing agent groups (Nos. 1, 8, 12, 15, 18, and 21), the following problems occurred. In No. 1 in which the turbidity difference among the toners of each color was 4.1, the fluidity of the toner was insufficient, whereby the transferability, image density, and sharpness were degraded. In No. 21, in which the turbidity difference was 47, toner dots near characters (toner dots near colored characters) increased due to instability of the balance of the charge amount, resulting in degradation of sharpness. In No. 21, imperfect transfer also resulted. In developing agent groups (Nos. 12, 15, and 18), in which the turbidity of any of the toners of each color was at least 60, the amount of free external additives increased excessively, whereby many black spots were formed and the sharpness was degraded. Further, of the developing agent groups which satisfied the requirements of the present invention, developing agent groups (Nos. 4, 5, 6, 10, and 20) in which the maximum turbidity difference among toners of each color was 10-35 and the turbidity of the black toner was less than 20, resulted in marked improved effects.

Example 2

Example of the use of Photoreceptor and the Surface Energy Reducing Agent is Supplied Photoreceptors 2 in the digital copying machine having the intermediate transferring member in Example 1 were each replaced by Photoreceptors 1 and the cleaning means was replaced by the cleaning means shown in FIG. 5 having the brush roller serving both as cleaning means and the agent supplying means, and zinc stearate was attached at 66K in FIG. 5. The evaluation was performed while supplying the zinc stearate to the photoreceptor surface through the brush roller in the same manner as in Example 1 using the developer groups (toner groups) illustrated in Table 2. The items, methods and norms of the evaluation were the same as those in Example 1.

Cleaning condition by the cleaning means having the agent Supplying Means Shown in FIG. 5.

Cleaning blade: A urethane rubber blade touched to the photoreceptor in the counter direction to the rotation direction of the photoreceptor.

Cleaning brush: Electroconductive acryl resin having a brush fiber density of $3\times10^3/cm^2$; the sinking depth of the brush fiber was set at 1.0 mm.

The evaluation was carried out under the foregoing conditions. The evaluation results almost the same as those in Example 1 were obtained by the evaluation. Namely, it was found that the same effects in Example 1 can be obtained by supplying the surface energy reducing agent to the photoreceptor surface even when the surface layer of the photoreceptor contains no fluororesin particles.

Example 3

Example of Varying the Particle Size Distribution of the Toner

Preparation of Toners 7Bk, 7Y, 7M and 7C

Toners 7Bk, 7Y, 7M and 7C were each prepared in the same manner as in Toners 2Bk, 2Yb, 2M and 2C, respectively, except that the $M(m_1+m_2)$ was varied by varying the classifying level by the centrifuge in the liquid. The number average particle diameter, the $M(m_1+m_2)$ and the turbidity of the toners are shown in Table 4.

Developer Group No. 22 composed of Toners 7Bk, 7Y, 7M and 7C was prepared by mixing 10 parts by weight of each of the above toners was mixed with 100 parts by weight of the ferrite carrier of 45 μm coated with styrene/methacrylate copolymer.

Preparation of Toners, 8Bk, 8Y, 8M, and 8C

Toners 8Bk, 8Y, 8M, and 8C were each prepared in the same manner as in Toners 2Bk 2Yb, 2M and 2C, respectively, except that the $M(m_1+m_2)$ was varied by varying the classifying level by the centrifuge in the liquid. The number average particle diameter, the $M(m_1+m_2)$ and the turbidity of the toners are shown in Table 4.

Developer Group No. 23 composed of Toners 8Bk, 8Y, 8M and 8C was prepared by mixing 10 parts by weight of each of the above toners was mixed with 100 parts by weight of the ferrite carrier of 45 μm coated with styrene/methacrylate copolymer.

TABLE 4

| Developer Group No. | Toner No. | Number average diameter of toner particles (μm) | $M(m_1+m_2)$ (%) | Turbidity of toner | Turbidity difference (Largest – Smallest) |
|---|---|---|---|---|---|
| 22 | 7Bk | 5.4 | 71.5 | 14.6 | 11.2 |
| | 7Y | 5.5 | 72.3 | 25.6 | |
| | 7M | 5.4 | 71.1 | 14.4 | |
| | 7C | 5.4 | 72.1 | 15.7 | |
| 23 | 8Bk | 5.7 | 68.3 | 21.5 | 15.7 |
| | 8Y | 5.8 | 68.5 | 37.2 | |
| | 8M | 5.7 | 67.8 | 23.3 | |
| | 8C | 5.7 | 68.8 | 23.6 | |

The test was performed in the same manner as in Combination No. 4 in Example 1 except that Developer Group No. 4 of Toners 2Bk, 2Yb, 2M and 2C was each replaced by non-magnetic single component Developer Group Nos. 22 and 23, respectively. Results of the evaluation are listed in Table 5.

TABLE 5

| Combination No. | Scattering of character image | Lacking of toner transfer | Black spot | Image density | Sharpness |
|---|---|---|---|---|---|
| 22 | B | A | A | A | A |
| 323 | B | B | B | A | B |

It is found in Table 5, Developer Group No. 22 in which the sum M of the relative frequency of the toner particles is not less that 70% is superior to the developer group in which M is less than 70% in the improving degree of each of the evaluated items.

The invention claimed is:

1. An image forming method employing an apparatus comprising a plurality of image forming units, an intermediate transferring member, an end transferring device and a fixing device, in which the plurality of image forming units each comprises, an electrophotographic photoreceptor, a latent image forming device to form an electrostatic latent image on the electrophotographic photoreceptor, a developing device to develop the electrostatic latent image with a developer comprising a toner to form a toner image on the electrophotographic photoreceptor, a first transferring device to transfer the toner image onto the intermediate transferring member, and a cleaning device to remove a toner remaining on the electrophotographic photoreceptor after transferring the toner image, wherein the method comprises forming a plurality of toner images on each of the photoreceptors, each of toner image having a different color;

transferring each of the toner images onto the intermediate transferring member from the photoreceptor by the first transferring device in each of the image forming units in sequence;

transferring the toner images formed on the intermediate transferring member onto a recording sheet by the end transferring device; and wherein the developer is a non-magnetic single component toner, the toner comprises colored particles and external additives in an amount of 0.05 to 5.0 parts by weight per 100 parts of the colored particles, turbidity of toners of each color is less than 60; and the maximum turbidity difference among the toners is 5-45, and a toner having the largest turbidity is a yellow colored toner among the color toners forming the color image.

2. The image forming method of claim 1, wherein the photoreceptor in at least one of the image forming units comprises a fluororesin in a surface layer thereof.

3. The image forming method of claim 1, wherein a surface energy reducing agent is supplied to at least one of the electrophotographic photoreceptors.

4. The image forming method of claim 1, wherein at least one of the toners exhibits sum M of the relative frequency m1 of toner particles included in the highest frequency class, and the relative frequency m2 of toner particles included in the second highest frequency class is number based histogram is at least 70 percent in which natural logarithm lnD is taken as the abscissa and said abscissa is divided into a plurality of classes at an interval of 0.23, D being diameter of toner particles in μm.

5. The image forming method of claim 1, wherein the maximum turbidity difference among the toners is 10-35.

6. The image forming method of claim 1, wherein the plurality of image forming units consist of yellow, magenta, cyan and black image forming units.

7. The image forming method of claim 6, wherein the black image forming unit forms a black toner image and turbidity of the black toner is not more than 20.

8. An image forming method of claim 1, wherein a yellow toner image is formed in a first photoreceptor and the yellow toner image is transferred by a first transferring device in a first image forming unit onto the intermediate transferring member, a magenta toner image is formed in a second photoreceptor and the magenta toner image is transferred by a second transferring device in a second image forming unit onto the intermediate transferring member having the yellow toner image, a cyan toner image is formed in a third photoreceptor and the cyan toner image is transferred by a third transferring device in a third image forming unit onto the intermediate transferring member having the yellow and magenta toner images, a black toner image is formed in a fourth photoreceptor and the black toner image is transferred by a fourth transferring device in a fourth image forming unit onto the intermediate transferring member having the yellow, magenta and cyan toner images, and the toner images on the intermediate transferring member is transferred by the end transferring device onto the recording sheet.

9. The image forming method of claim 1, wherein the plurality of toner images are yellow, magenta, cyan and black toner images.

* * * * *